United States Patent [19]

Braunhut

[11] 4,456,255

[45] Jun. 26, 1984

[54] SPRING WHIP DEFENSIVE WEAPON

[76] Inventor: Harold N. Braunhut, 200 Fifth Ave., New York, N.Y. 10010

[21] Appl. No.: 419,789

[22] Filed: Sep. 20, 1982

[51] Int. Cl.[3] ..... F41B 15/00

[52] U.S. Cl. ..... 273/84 R; 231/2 R

[58] Field of Search ..... 273/84 R, 84 ES, 80 D; 231/2 R, 3; 135/75; 15/144 B

[56] References Cited

U.S. PATENT DOCUMENTS

| | | | |
|---|---|---|---|
| 2,162,157 | 6/1939 | Clark | 273/84 R |
| 3,554,546 | 1/1971 | Braunhut | 273/84 R |
| 4,037,839 | 7/1977 | Nelson | 273/84 R |
| 4,135,719 | 1/1979 | Braunhut | 273/84 R |

*Primary Examiner*—George J. Marlo

*Attorney, Agent, or Firm*—Goodman & Teitelbaum

[57] ABSTRACT

A spring whip which defines a defensive weapon for emergency use to disarm an attacker carrying and intending to use a knife, gun or any other type of offensive weapon, the spring whip having a hollow housing serving as a hand grip and providing an internal storage compartment for receiving plural lengths of helically wound springs, the springs being of sequentially increasing larger diameter size. The springs are operatively arranged relative to each other about a common axis so as to be maneuverable between a telescoped stored position within the housing compartment and an extended whipping position extending from one end of the housing. The lengths of springs are alternately wound in opposing clockwise and counter clockwise directions to facilitate moving between the telescoped stored position and the extended position, and also to permit threading together of adjacent sections, to thereby securely lock them in place in the extended position.

15 Claims, 11 Drawing Figures

SPRING WHIP DEFENSIVE WEAPON

BACKGROUND OF THE INVENTION

The present invention relates to a defensive weapon, and more particularly to a spring whip which can be conveniently carried by a person and is available to be readily put into a whipping position for emergency use to disarm an attacker carrying and intending to use a knife, gun or any other type of offensive weapon.

The need for defensive weapons continues to increase along with the crime rate. While various types of defensive weapons are available, many of these require considerable time to assemble and place into an operative position. Others are only of the type which call for aid but do not provide an immediate weapon to defend the person being attacked. Yet other available defense weapons are lethal, such as firearms or chemicals, and are therefore of such a dangerous character as to be avoided by many people.

A particularly useful defensive weapon, which can be conveniently carried by a person and available for emergency situations, is a spring whip. A basic spring whip has been described in my U.S. Pat. No. 3,554,546 as a device which is formed of interconnected lengths of spring. The selected diameter of the springs provides a compact, telescoped arrangement which permits the convenience of carrying the device. The successive lengths of springs permit interconnection of the spring lengths in their extended position by having the diameters sequentially increased in size. The lengths of the springs are stored in a housing which also serves as a hand grip.

An improved version of the spring whip has been described in my U.S. Pat. No. 4,135,719. In the improved version, a weighted tip was placed on the innermost, smallest diameter spring, which served both as a closure for the housing and also to facilitate the projection of the springs into their extended whipping position. The improved spring whip also provided for a magnet placed within a cap in the housing which retained the springs in their stored position and prevented the possibility of having the telescoped lengths of springs accidentally moved into their extended whipping position. Furthermore, in order to facilitate disengagement after the extended spring lengths have been wedged into their projected position, an antifriction coating was placed at least along the edges of the lengths of springs which get wedged together.

While the improved spring whip, as well as the basic spring whip, have both been found quite useful and effective, further improvements would be warranted in order to facilitate projection of the spring lengths and avoid any possibility of locking of adjacent lengths of springs during movement between the retracted, telescopic stored position and the projected, extended position. Furthermore, although the wedging effect of the previously described spring whips is normally sufficient to retain the spring lengths in their extended position, occasionally it is desired to securely lock them in this position to avoid the possibility of their being accidentally telescoped together during emergency action. Also, other improvements would be warranted in order to avoid damage to the spring whip during utilization and to preserve the structural elements forming the spring whip.

SUMMARY OF THE INVENTION

Accordingly, it is an object of the present invention to provide an improved spring whip which avoids the problems of the prior art, and which provides a defensive weapon for emergency use to disarm an attacker carrying and intending to use a knife, gun or any other type of offensive weapon.

Yet another object of the present invention is to provide a spring whip which can be easily moved between its telescoped stored position and its projected position without having the springs lock or grasp onto each other.

It is a further object of the present invention to provide a spring whip which includes lengths of springs which can be interlocked in an extended position to avoid accidental collapsing and telescoping together thereof.

A further object of the present invention is to provide a spring whip including a magnet which retains the lengths of springs in a retracted position and which includes a coating on the magnet to avoid flaking of the magnet.

Another object of the present invention is to provide a spring whip having a magnet secured within a cap on top of the housing which in turn retains lengths of springs in a telescoped stored position, and wherein the cap is spot welded to the housing to secure its retention therein.

Yet a further object of the present invention is to provide a spring whip having a plurality of lengths of springs with different diameters, with the smallest diameter length being securely retained within the seat of a tip portion disposed at the forward end of the housing.

Yet another object of the present invention is to provide a spring whip having a plurality of lengths of springs retained within a housing serving as a hand grip, and wherein the hand grip includes a coating thereon to provide a better gripping effect thereto.

Still a further object of the present invention is to provide a spring whip contained within a housing and including a cap at the top of the housing in which a suitable emblem can be placed.

Another object of the present invention is to provide an elongated spring whip having a plurality of lengths of springs telescoped together within a housing, and having a cap on the housing with an axially extended screw to which can be connected anyone of a housing extension, a bludgeon, a gripping handle, or other like sections.

A further object of the present invention is to provide a spring whip having a plurality of lengths of springs retained within a housing and maintained in its telescopic stored position by means of a magnet seated in a cap in the housing, wherein the magnet contains a notch and the cap has a crimp corresponding to the notched position to thereby securely retain the magnet in the cap.

Briefly, the invention provides for a spring whip having a hollow housing which serves as a hand grip and provides an internal storage compartment. Plural lengths of helically wound springs are retained in the storage compartment. The springs are of sequentially increasingly larger diameter sizes. The springs are operatively arranged relative to each other about a common axis so as to be movable between a telescoped stored position within the storage compartment, and an extended whipping position extending from a first end of the hollow housing. The lengths of springs are alternately wound in opposing clockwise and counterclockwise directions to thereby facilitate movement between the telescoped stored position and the extended position. The telescoped ends of adjacent telescoped pairs of springs are of cooperatively progressively diminishing diameter to facilitate wedging engagement therebetween at termination of movement of the springs into the extended whipping position. At the same time, the adjacent pairs of springs can be threaded at termination of movement in order to lock these pairs of springs in their extended position.

BRIEF DESCRIPTION OF THE DRAWINGS

With the above and additional objects and advantages in view, as will hereinafter appear, this invention comprises the devices, combinations and arrangements of parts hereinafter described, by way of example and illustrated in the accompanying drawings of a preferred embodiment in which.

In the various figures of the drawing, like reference characters designate like parts.

DESCRIPTION OF THE PREFERRED EMBODIMENTS

Figure 1:
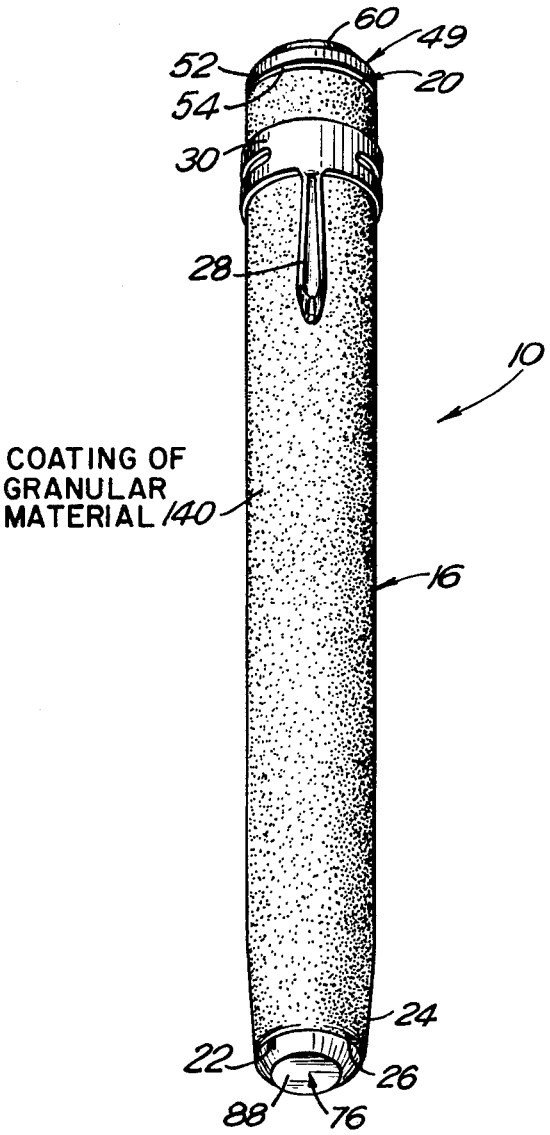
FIG. 1 is a perspective view of the defensive weapon of the present invention, with the spring lengths thereof being in their storage position within the hand grip housing.
Figure 6:
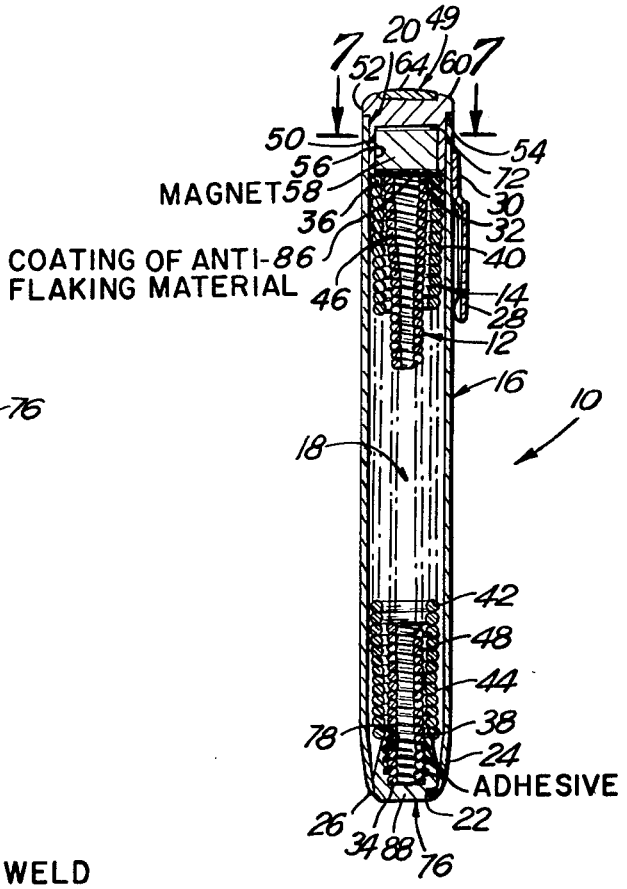
FIG. 6 is a side elevational view showing the spring whip with the spring lengths thereof in the stored position within the hand grip housing.
Figure 8:
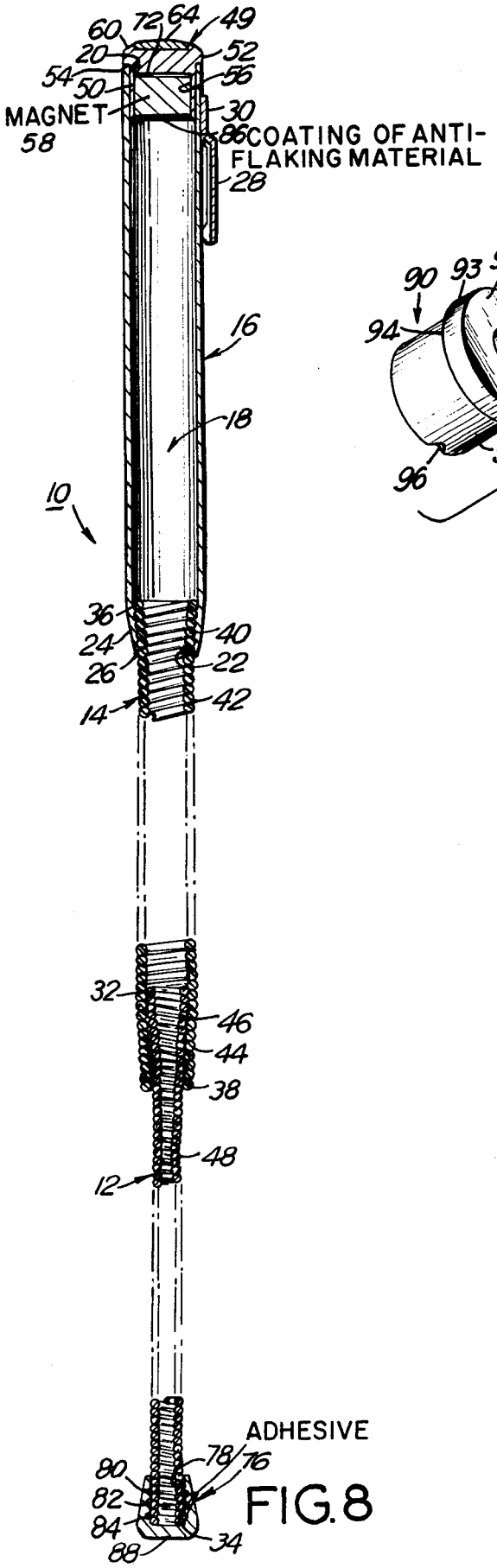
FIG. 8 is a sectional view illustrating the spring lengths in their extended position from the hand grip housing.

In the figures, there is shown a defensive weapon, specifically a spring whip generally designated at 10 which is constructed essentially of plural lengths of springs. In the embodiment shown, there are provided two springs 12, 14 which are interconnected together to form an elongated configuration which can be used effectively as a whip. The springs 12, 14 can be retained in a compact, telescoped stored position, as is shown in FIGS. 1 and 6, so that it can be conveniently stored in a small space, such as a purse or pocket. At the same time, the springs 12, 14 can be conveniently put into use as a whip by extending the springs 12, 14 into their whipping position, as shown in FIG. 8.

The spring whip 10 includes a hollow elongated housing 16, shown as a cylindrical member. The housing 16 defines an internal cylindrical shaped storage compartment 18, and includes an upper entrance opening 20, and a lower smaller exit opening 22. The lower exit opening 22 is formed with a slight taper at the lower end 24 to provide the smaller exit opening. The lower opening 22 preferably includes a conical lip 26, the purpose of which will hereinafter be described. The housing 16 conveniently includes a pocket clip 28 with a retaining ring 30, which provides for convenience of carrying the weapon in a pocket.

The helical springs 12, 14 are conventionally wound. However, the springs 12, 14 are respectively wound in opposing directions. Thus, by way of example, the spring 12 is shown as being wound in a clockwise direction commencing at the upper end 32 and continuing in a clockwise direction until it terminates at the lower edge 34. On the other hand, the spring 14 is wound in a counter clockwise direction. The spring 14 commences with an upper coil turn portion 36 and continues in a counter clockwise direction until it terminates at its lower turn portion 38. Although only two lengths of springs 12, 14 are shown, it should be appreciated that with three or more lengths of springs, they would be alternately wound, alternating between a clockwise direction for one length, a counter clockwise for the next length, and again a clockwise direction for the third length, etc.

The larger diameter spring 14 has its upper end portion 40 outwardly flared or tapered from its central body portion 42, and its lower end 44 tapered narrower than the central body portion 42. This can be achieved, by way of example, by having the first few turns of the spring 14 formed with progressively increasing diameters at the upper end 40 thereof, while the last few helical turns at its lower end 44 are tapered with progressively diminishing diameters.

Spring 12, like spring 14, also has its upper end portion 46 outwardly flared or tapered so as to be wider than the rest of the spring body portion 48. However, the rest of the body portion 48 is uniform. In order to achieve the upper flare, the top few helical turns can be formed with progressively increasing diameters.

By so shaping the springs 12, 14, the springs will form interconnections permitting telescoping of the springs 12, 14. At the same time, in their extended position, there will be a wedging engagement. Specifically, with regard to the spring 14, the lower narrower diameter portion 44 is permitted to pass through the upper opening 20, and through the lower opening 22 of the conical lip 26 of the housing 16, while the upper wider portion 40 of the spring 14 can only pass through the upper opening 22 of the conical lip 26, as is clearly shown in FIG. 8. In a similar manner, the wider upper end 46 of the spring 12 is held by the narrower lower end 44 of the spring 14. However, the rest of the body portion 48 of the spring 12 is able to pass through the narrower lower end 44 of the spring 14. It is noted, that the entire spring 12 can pass through the upper end portion 40 and the central body portion 42 of the spring 14.

In this way, the springs can be telescopically positioned one within the other so that both springs 12, 14 have a common axis, and thus the springs can be retained in a stored position within the housing compartment 18 as shown in FIG. 6. At the same time, they can be projected into their extended whipping position whereby the ends 44, 46 of adjacent springs will form a wedging engagement with each other to hold the springs in their extended positions.

While only two such springs are shown, additional springs could be included, wherein each of the additional springs would be of progressively smaller diameter with respect to the spring immediately above or around it, and with each of the springs being of a similar shape to the spring 14. Specifically, each of the other springs would have its upper end wider than the central body portion, and the lower end narrower than the central body portion. It is only the innermost, smallest diameter spring, which only includes a wider upper portion with a substantially uniform remaining body portion.

Because the adjacent springs are wound in opposing directions, the sliding movement between the adjacent springs, as they move between the stored and extended positions, will avoid the possibility of a locking or catching effect between the springs. In both of the aforementioned patents describing the prior art spring whips, all of the springs were commonly wound in a single uniform direction. As a result, the possibility of having the springs lock and catch one within the other as they moved between the stored and projected positions was possible. Additionally, once the adjacent springs became wedged in their projected position, it became extremely difficult to release the springs so as to return the spring lengths back to their stored position.

In order to reduce the possibility of locking during the projection of the spring lengths and also to facilitate release of their wedged condition, the aforementioned U.S. Pat. No. 4,135,719 provided the addition of an antifriction coating on the springs. While such coating is effective with continued use, the coating tends to wear off and again the problem of locking and unwedging the springs persists.

By winding the adjacent lengths of springs in opposing directions, these above problems are permanently avoided. Because the springs are wound in opposing directions, as one length of spring projects within the other spring to move into its extended position, there will be avoided the possibility of locking or catching of the two spring sections. At the same time, once they are wedged together in the projected position, in order to release adjacent lengths of springs, it is only necessary to firmly push the springs into the housing 16 by first pushing the smaller diameter spring 12, where it may be needed to turn the smaller diameter spring 12 in the direction in which it is wound before pushing same. Specifically, as shown in FIG. 8, with the smallest diameter spring 12 being wound in a clockwise direction, by rotating it in a clockwise direction, it will be released from its wedged position within the spring 14.

Additionally, a most unexpected benefit results from forming adjacent lengths of the springs in oppositely wound directions. Specifically, it is now possible to thread one length of spring into the adjacent length of spring during the projected position thereof to thereby lock the lengths of the projected springs together. Although previously the springs were only held in the projected position by the wedging action therebetween, such wedging action could be released by pressing or pushing on the lower length of spring. Therefore, during emergency situations where the lengths of springs are projected, if one were to use the prior art device as a weapon and push at the lower end, the wedging action may be released, thereby causing the prior art spring whip to become telescoped and lose its effectiveness.

However, now that the adjacent lengths of springs are helically wound in opposing directions, when the lengths of springs are projected, by rotating the smaller diameter spring 12 in a direction opposite to its wound direction, you can thread its wider flared portion 46 into the lower tapered portion 44 of the next adjacent larger diameter spring 14, and thereby securely lock the two springs 12, 14 together, whereby applied pressure on the lower end of spring 12 will not release the two springs and thereby the springs 12, 14 will not accidentally telescope during emergency use.

Specifically, as shown in FIG. 8, with the lower smaller diameter spring 12 being in its projected position, its wider flared end 46 will engage the narrower tapered lower end 44 of the next adjacent spring 14. By rotating the spring 12 in a direction opposed to its winding direction, it will thread the end 46 within the spiral grooves formed by the narrower tapered end 44 of the spring 14. This will actually thread the two springs 12, 14 together and avoid the possibility of accidental telescoping by applying pressure to the lower end 34 of the spring 12.

Once the two springs 12, 14 have been threaded together, should it be desired to release them, it is only necessary to unthread the lower spring 12 from the adjacent spring 14, and then return them to the telescoped stored position within the housing 16.

Figure 3:
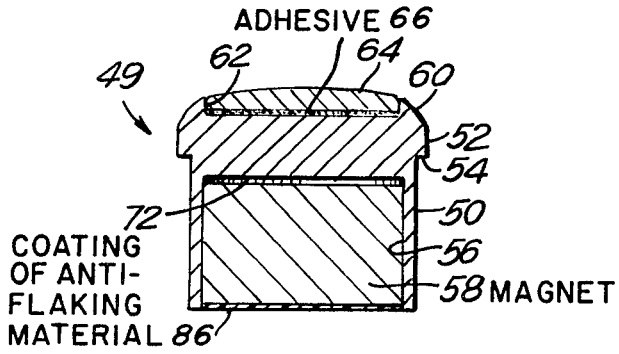
FIG. 3 is a sectional elevational view of the cap and magnet provided in the top of the housing of the present invention.

In order to retain the springs in their telescoped stored position within the housing 16, there is provided a magnet at the upper opening 20 of the housing, wherein the springs are fabricated from a magnetic attracting material. The magnet is held within a cap 49. As can best be seen in FIG. 2–4, the cap 49 includes a substantially tubular lower body portion 50 integral with a larger diameter upper head portion 52, including a peripheral shoulder 54 therebetween. A bore or seat 56 is formed within the body portion 50 and is available to accommodate the magnet designated at 58. The upper end of the head portion 52 includes a beveled edge 60, and a recess 62 is formed into the top thereof. Positioned within the recess is a disk 64 on which can be placed an emblem for decorative purposes. The emblem can be secured within the recess by means of an adhesive 66.

Figure 4:
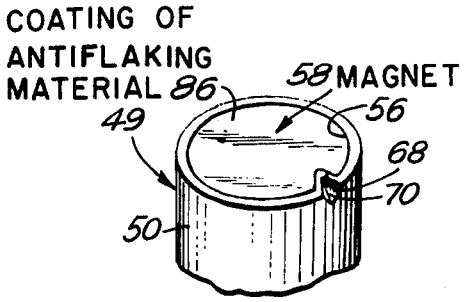
FIG. 4 is a fragmented perspective view showing the bottom of the cap with the magnet secured in place within a hollow portion of the cap body.

The magnet 58 is a substantially cylindrical member with a notch 68 formed at one point of its lower peripheral edge. As is best seen in FIG. 4, when the magnet 58 is inserted within the bore 56 of the body portion 50, also fabricated from a magnetic attracting material, it can be secured within the body portion by means of a press fit or with the use of an adhesive in addition to the magnetic attraction therebetween. However, in order to further retain the magnet 58 securely positioned therein, after it has been properly fitted into the bore 56, a crimp 70 is formed in the lower peripheral edge of the body portion 50 engaging in the notch 68 in the magnet 58 to thereby securely retain the magnet 58 in place so that the magnet 58 is not pulled out by the action of the springs 12, 14.

In assembling the magnet within the bore 56 of the body portion 50 of the cap 49, because there is a tight fit, a slight air space 72 is provided between the magnet 58 and the head portion 52.

Figure 7:
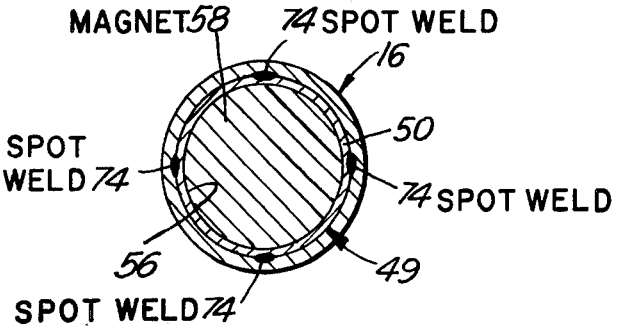
FIG. 7 is a cross sectional view taken along line 7—7 of FIG. 6, showing the cap spot welded within the upper end of the hollow housing.

The cap 49 is then inserted into the upper opening 20 of the housing 16 and is retained in place by means of spot welds 74, as shown in FIG. 7. The spot welding can be done externally of the housing 16 and will serve to weld the cap body wall 50 directly to the internal peripheral wall of the housing 16. Although four spot welds 74 are shown, this is merely by way of example and any suitable number of welds can be utilized to adequately secure the cap in place.

A tip portion 76 is provided at the distal end 34 of the smallest diameter spring 12. The tip portion 76 has a frustroconical configuration with its base being of substantially circular configuration and being of a size substantially equal to the lower opening 22 of housing 16. A seat 78 is formed into the tip portion 76 of a size to accommodate the distal end 34 of the spring 12 which is inserted into the tip seat 78. The tip portion 76 serves as a weighted end to the lengths of springs in order to aid in the projection of the springs into their extended whipping position. At the same time, it also serves as a closure for the lower opening of the housing 16, where the tip portion 76 abuts the lip 26 of the housing to thereby provide a smooth finished end to the housing and prevent any hazards to the carrier of the weapon when in a stored condition.

Figure 5:
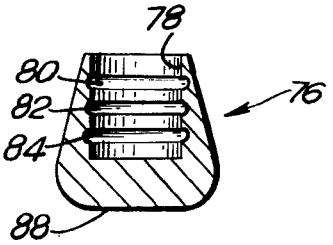
FIG. 5 is a side sectional view showing the lower tip portion which serves as a weighted member for facilitating projection of the springs, and as a closure member for the hollow housing.

It is noted, as best shown in FIG. 6, that the spring 12 is longer than the spring 14 to accommodate the tip portion 76 at the end thereof. In order to facilitate the retaining of the lower end 34 of the spring 12 into the seat 78 in the tip portion, adhesive is placed around and into the spring turns. At the same time, a plurality of circular grooves 80, 82, 84 are formed about the internal periphery of the seat 78, as shown in FIG. 5. Accordingly, when the lower end 34 of the smallest diameter spring 12 is inserted into the conical tip portion 76, and when the adhesive is placed therein, the adhesive will flow into the grooves 80, 82, 84 and also will flow about and into the spherical turns at the end 34 of the spring 12, and thereby securely retain the spring in place within the tip portion 76.

In order to facilitate retaining the springs in their telescoped stored position within the housing, the upper ends of the springs 12, 14 are ground flat, as shown at turn 32 of the smaller diameter spring 12 and at turn 36 of the larger diameter spring 14. In this way, there will be provided an abutting surface against the outer face of the magnet 58.

As the lengths of springs are continuously telescoped into their stored position by abutting the outer face of the magnet, there could result a tendency of the outer face of the magnet to flake, which could effect the telescoping action of the springs. In order to reduce such possibility of flaking, the outer face of the magnet is coated with a thin layer of chemical material 86. The coating 86 is formed of a material which is compatible with the ceramic material of the magnet 58 so the chemical bonding does not inhibit the strength of the magnet.

Typically, a material including nylon fibers could be utilized to coat the magnet. Such nylon fibers provide for strength as well as impact absorption for the magnet. Additionally, a mixture can be formed of the nylon fibers with other materials such as nitrocellulose wihich provides an adhesive for securement to the magnet surface, and also as a carrier of the nylon fibers. Also, a formaldehyde resin can be included in the mixture to soften and prevent cracking of the chemical material 86. Binders could also be included, such as ethyl acetate or butyl acetate, or both. Furthermore, toluene could be included, as could isoproply alcohol and/or butyl alcohol as a thinner material, where other like materials could also be added.

Typically the material 86 is coated onto the surface of the magnet in a thin layer of approximately 1/10,000th of an inch. The material 86 is such as to be compatible and chemically bound to the magnet 58. It prevents the magnet from flaking, chipping or cracking. Furthermore, it is heat resistant in order to permit welding of the cap into the housing, as heretofore described.

The length of the smaller diameter spring 12 with the tip portion 76 assembled thereto is such that its composite length is equal to the distance from the outer face of the magnet 58 to the lower edge of the housing 16, as can best be seen in FIG. 6. In this manner, the bottom surface 88 of the tip portion 76 will serve to close the exit 22 of the housing 16, and at the same time, the flattened end 32 of the spring 12 will be abutting the magnet 58.

Figure 2:
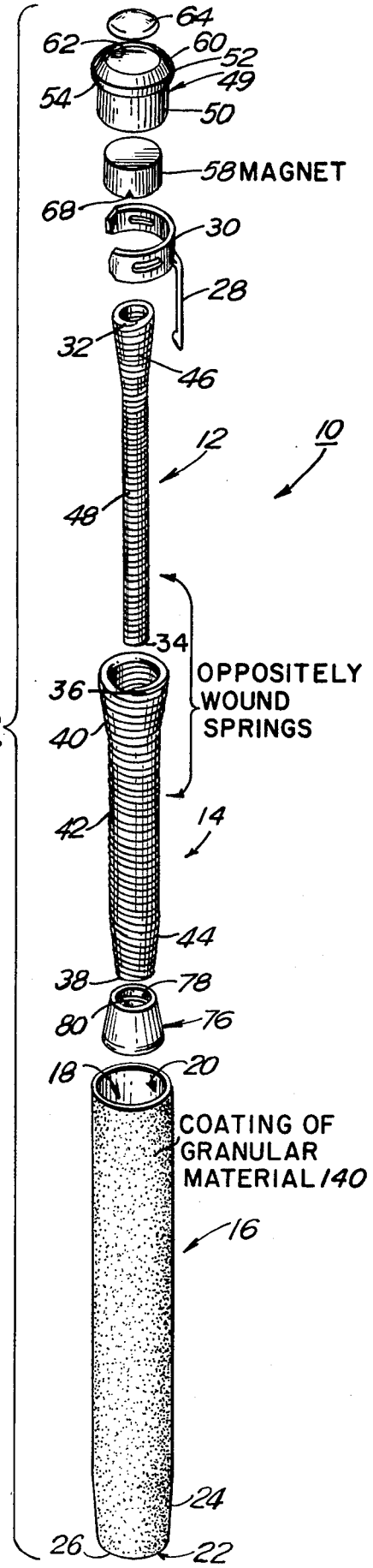
FIG. 2 is an exploded perspective view of the various parts forming the spring whip in accordance with the present invention.

In assembling the spring whip, as can best be seen in FIG. 2, the springs 12, 14 are placed one inside the other in a telescopic arrangement. The tip portion 76 is then secured onto the end 34 of the smaller diameter spring 12. The telescoped springs are then inserted into the wide opening 20 of the housing 16 so that the tip portion is positioned adjacent to the conical lip 26 on the lower portion 24 of the housing. It is noted, that the lower portion 24 is tapered by preferably a rolling process. The magnet is then press fit into the cap and the body portion of the cap is then inserted into the housing and is spot welded thereto. It is noted that the outer diameter of the head portion 52 of the cap 49 approximately equals the outer diameter of the housing 16, as can best be seen in FIGS. 1, 6 and 8. In this manner, the cap head portion does not provide for any protrusion onto the device and provides for a smooth exterior.

Figure 9:
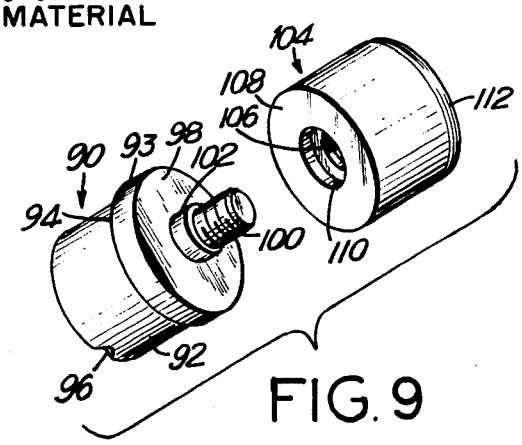
FIG. 9 is an exploded perspective view of another embodiment showing a modified cap member having an axially extended screw for adding on an additional extended cap portion.

Referring now to FIG. 9, another embodiment of a cap 90 is shown. The cap 90 includes a substantially tubular cylindrical body portion 92 with an enlarged circular head portion 93 which would fit above the top of the housing 16. A shoulder 94 would securely fit at the upper opening 20 of the housing. A crimp 96 is formed to engage the notch 68 formed in the magnet. The magnet 58 fits within a bore formed into the tubular body portion 92. Up to this point, the cap 90 is similar to the cap 49.

Extending axially upwardly from the top surface 98 of the head portion 93 of the cap 90 is an externally threaded screw 100. An enlarged collar 102, which is unthreaded, is formed at the base of the screw 100.

Various types of extensions can be placed onto the cap 90 by way of the screw 100. For example, FIG. 9 shows a cylindrical body member 104 which can be screwed onto the cap 90. A threaded bore 106 is provided centrally of the lower surface 108 of the extension member 104 to receive the screw 100. An enlarged counterbore 110 is provided to engage the collar portion 102 of the cap 90. At the upper surface of the extension member 104, there could be again provided the beveled edge 112 and a recess could be provided therein for receiving an insert such as a disk or other emblem 64, similar to the structure of the cap 49.

Figure 10:
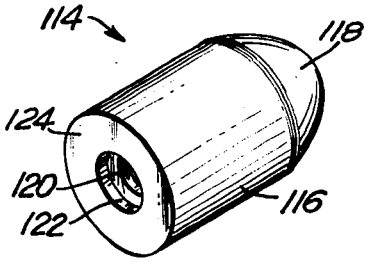
FIG. 10 is a perspective view of another additional extension portion in the form of a bludgeon.

FIG. 10 shows another type of extension member which also could be secured onto the cap 90 of FIG. 9. In this case, a bludgeon 114 is shown having cylindrical body portion 116 which terminates at its upper end in a conical head section 118. Again, a threaded bore 120 is provided with an enlarged counter bore 122 at the lower surface 124 of the extension member or bludgeon 114. This would also thread onto the cap screw 100 and provide an additional part of a defensive weapon.

Figure 11:
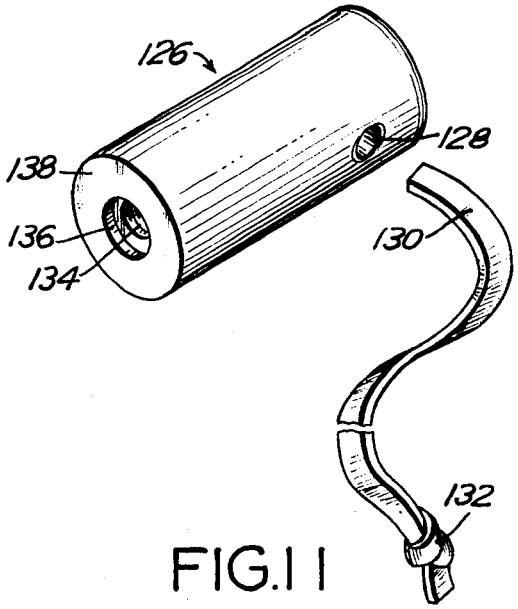
FIG. 11 is a perspective view of another extension portion in the form of a hand grip and strap.

FIG. 11 shows yet another type of extension member which could be connected onto the cap 90. In this case, there is shown a cylindrical elongated body member 126 which could provide for additional gripping of the handle in order to make it easier to hold or swing. Additionally, a transverse bore 128 is formed near its upper edge to receive therethrough a handle or strap 130. A knot or other stop means 132 is provided at one end of the strap 130 to maintain the strap 130 in the bore 128. By means of the threaded bore 134 and enlarged counter bore 136 formed in the lower surface 138 of the extension member 126 shown in FIG. 11, this could again be attached onto the cap screw 100. Using this extension member 126, there is provided a strap or handle which can be wrapped about the user's hand to facilitate use of the spring weapon also as a club or night stick.

In order to facilitate the grasping of the hand grip or housing 16, the outer surface of the housing 16 is coated with a rough material 140, as shown in FIG. 1. By way of example, sand or diamond dust contained in an epoxy could be used to coat the peripheral outer surface of the housing 16 to provide the improved gripping thereof.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A spring whip comprising:

a hollow housing serving as a hand grip and providing an internal storage compartment for receiving plural lengths of helically wound springs:

said springs being of sequentially increasingly larger diameter sizes;

said springs being operatively arranged relative to each other about a common axis so as to be movable between a telescoped stored position within said storage compartment and an extended whipping position extending from one end of said hollow housing;

an inner end of one spring being adjacent to an inner end of a second spring in said telescoped stored position; and means for avoiding coils of said one spring from catching between coils of said second spring during movement of said springs between said telescoped stored position and said extended position;

said means including lengths of said springs being alternately wound in opposing clockwise and counter clockwise directions with said one spring being wound in a clockwise direction commencing at said inner end of said one spring and said second spring being wound in a counter clockwise direction commencing at said inner end of said second spring.

2. A spring whip as in claim 1, wherein outer ends of adjacent pairs of springs are of cooperatively progressively diminishing diameter for threaded and wedging engagement therebetween at termination of movement of said springs into said extended whipping position.

3. A spring whip as in claim 1, and further comprising a magnet positioned at an opposite end of said hollow housing, said springs being fabricated from a magnetic attracting material, and cap means for retaining said magnet and closing said opposite end of said hollow housing, said magnet having a notch in its peripheral edge and said cap means having a corresponding crimp in its periphery for engaging in said notch to thereby retain said magnet in said cap means.

4. A spring whip as in claim 3, wherein an exposed surface of said magnet is coated with a thin layer of antiflaking material.

5. A spring whip as in claim 4, wherein said antiflaking material includes nylon fibers.

6. A spring whip as in claim 5, wherein said antiflaking material further includes nitrocellulose, formaldehyde resin, an acetate, toluene and an alcohol.

7. A spring whip as in claim 1, and further comprising cap means including a tubular body portion and an enlarged head portion connected thereto, said tubular body portion extending into an opposite end of said hollow housing with said head portion sitting above said hollow housing, a magnet being retained within said tubular body portion for maintaining said springs in said stored position, and spot welds retaining said tubular body portion within said hollow housing.

8. A spring whip as in claim 7, and comprising a recess formed into said head portion, and emblem means secured into said recess.

9. A spring whip as in claim 7, and further comprising a screw longitudinally extending from said head portion, and extension means having an internally threaded bore for threading onto said screw.

10. A spring whip as in claim 9, and further comprising an unthreaded cylindrical collar member provided at the base of said screw, and a correspondingly shaped unthreaded counter bore at the mouth of said threaded bore for engaging said collar member.

11. A spring whip as in claim 9, wherein said extension means comprises a bludgeon.

12. A spring whip as in claim 9, wherein said extension means comprises a longitudinally extending body member, and strap means coupled to said body member.

13. A spring whip as in claim 1, and further comprising granular means for coating an exterior of said housing.

14. A spring whip as in claim 13, wherein said granular means includes sand in an epoxy base.

15. A spring whip as in claim 1, and further comprising a tip member, a circular seat provided therein for receiving a distal end of the smallest diameter spring, circular grooves provided peripherally into said tip member about said circular seat, and adhesive means provided in said circular seat and anchored between the spiral turns of said distal spring end and said circular grooves to thereby provide retention of said distal spring end in said circular seat.

* * * * *